US008292110B2

(12) United States Patent
Rutter et al.

(10) Patent No.: US 8,292,110 B2
(45) Date of Patent: Oct. 23, 2012

(54) CONTAINER HAVING DUAL-MODE CLOSURE ASSEMBLY

(75) Inventors: Bryce G. Rutter, St. Louis, MO (US); Marc Hunter, Webster Groves, MO (US); Feng Feng, Chesterfield (CN); David D. Kusch, St. Louis, MO (US); Melvin J. Leedle, St. Louis, MO (US); Jonathan Sundy, St. Louis, MO (US)

(73) Assignee: Gunn and Richards, Inc., Lenexa, KS (US)

( * ) Notice: Subject to any disclaimer, the term of this patent is extended or adjusted under 35 U.S.C. 154(b) by 876 days.

(21) Appl. No.: 12/249,058

(22) Filed: Oct. 10, 2008

(65) Prior Publication Data

US 2010/0089861 A1 Apr. 15, 2010

(51) Int. Cl.
*B65D 51/18* (2006.01)

(52) U.S. Cl. ..... 220/254.3; 220/817; 220/836; 215/230; 215/201; 215/235

(58) Field of Classification Search ..... 215/230, 215/216, 201, 235, 237; 220/324, 817, 818, 220/836, 837, 254.3; 206/528, 536, 807
See application file for complete search history.

(56) References Cited

U.S. PATENT DOCUMENTS 3,613,873 A * 10/1971 Schulman ..... 206/752
4,759,455 A 7/1988 Wilson
4,782,964 A 11/1988 Poore et al.
4,809,874 A 3/1989 Pehr
5,031,784 A 7/1991 Wright
5,040,691 A 8/1991 Hayes et al.
5,083,671 A 1/1992 Hayes
5,137,260 A 8/1992 Pehr
5,180,072 A 1/1993 Oehlert
5,238,130 A 8/1993 Marques et al.
5,417,339 A * 5/1995 Liu ..... 220/315
5,765,705 A 6/1998 Deubel
5,860,543 A 1/1999 Decelles
5,878,898 A * 3/1999 Shefflin ..... 215/11.6
5,927,535 A 7/1999 Goth
6,161,711 A 12/2000 Miceli et al.

(Continued)

*Primary Examiner* — Mickey Yu
*Assistant Examiner* — Kareen Rush
(74) *Attorney, Agent, or Firm* — Hovey Williams LLP

(57) ABSTRACT

Dual-mode container assemblies (30, 110) are provided which include an open-top container (32, 112) with a closure assembly (34, 114) having a skirt (36, 116) and a reversible lid (38, 118) presenting first and second opposed faces (82, 84, 160, 162) hingedly coupled to the skirt (36, 116). In the child-resistant configuration of the assemblies (30, 110), the lid (38, 118) is latched to the skirt (36, 116) by a latching arrangement (60, 100, 136, 177). In order to convert the container assemblies (30, 110) to an adult configuration, the lid (38, 118) is opened and rotated 180° while the lid (38, 118) remains connected to the skirt (36, 116). This reverses the lid face adjacent the open top of the container (32, 112). Closure of the reversed lid (38, 118) occurs without any latching function between the skirt (36, 116) and the lid (38, 118), so that the lid (38, 118) can be readily opened. The connection between the lid (38, 118) and skirt (36, 116) can be effected by hinged connection of rear segment (64) and rotational coupling of a forward reversible body (75), or by a ball joint connection between a ball (170) and ball mount (150). In either case, the lid (38, 118) is moveable about respective transverse axes to permit changeover between the child-resistant and adult configurations of the container assemblies (30, 110).

25 Claims, 22 Drawing Sheets

U.S. PATENT DOCUMENTS

| | | | | |
|---|---|---|---|---|
| 6,171,711 | B1 | 1/2001 | Draghi et al. | |
| 6,378,533 | B1 * | 4/2002 | Roman | 132/295 |
| 6,526,989 | B2 * | 3/2003 | Sheffler et al. | 132/294 |
| 6,612,450 | B1 | 9/2003 | Buono | |
| 6,772,902 | B1 | 8/2004 | White | |
| 7,108,447 | B2 | 9/2006 | Akkala et al. | |
| 7,124,904 | B1 | 10/2006 | Miceli et al. | |
| 7,198,161 | B2 | 4/2007 | Bucholtz | |
| 2006/0219727 | A1 | 10/2006 | Giraud | |
| 2007/0062901 | A1 | 3/2007 | Konefal | |
| 2007/0267379 | A1 | 11/2007 | Creasap | |

* cited by examiner

CONTAINER HAVING DUAL-MODE CLOSURE ASSEMBLY

BACKGROUND OF THE INVENTION

1. Field of the Invention

The present invention is broadly concerned with container assemblies for medicaments or the like which are readily convertible between a latched, child-resistant configuration and an unlatched, adult configuration. More particularly, the invention is concerned with such container assemblies and corresponding methods wherein a closure assembly is provided for securement to the open top of a container, with the closure assembly including a lid presenting opposed faces and rotatably mounted so as to permit full rotation of the lid to the child-resistant or adult orientation thereof while the lid remains coupled to the closure assembly. Thus, the lid changeover is accomplished without separation of the lid from the container and closure assembly.

2. Description of the Prior Art

Numerous child-resistant closure devices for preventing access to containers storing dangerous substances such as medicaments, poisons, or household cleaners have been developed in the past. While such devices provide a measure of safety for children, they can be difficult to manipulate by older or disabled persons of limited dexterity. Accordingly, convertible closure devices have also been provided in the past, so that the devices can be alternately configured in a child-resistant or easy-open adult orientations.

U.S. Pat. No. 6,612,450 discloses a cap assembly which has one side providing a child-resistant closure, whereas the other provides a non-child-resistant closure. In order to change between the configurations, it is necessary to bodily remove the cap from the vial and reverse it for re-attachment to the vial in the new configuration. Similarly, U.S. Patent Publication Nos. 2007/0062901 and 2007/0267379 disclose reversible, dual-function vial caps which again require cap removal and inversion in order to switch between the alternate configurations. Finally, U.S. Pat. No. 7,124,904 describes a reversible closure wherein the closure includes an outer cap and a coaxial, nested inner cap. In order to convert the closure from the child-resistant mode to the non-child-resistant mode, the outer cap is removed, inverted and re-attached.

U.S. Pat. No. 5,040,691 describes a child-resistant closure having an easy-open feature. In this design, the closure is rotatably attached to a container and has a depending skirt and a hinged lid carrying a latching member. The lid latches only if the closure is turned to a positioned such that the latch is aligned with a slot in the latching flange. Rotation of the closure relative to the slot, once the latch has been engaged through the slot, locks the lid against opening.

Other references include: U.S. Pat. Nos. 4,759,455; 4,782,964; 4,809,874; 5,031,784; 5,083,671; 5,137,260; 5,180,072; 5,238,130; 5,765,705; 5,860,543; 5,927,535; 6,161,711; 6,171,711; 6,772,902; 7,108,447; 7,198,161; and US Published Application No. 2006/0219727.

SUMMARY OF THE INVENTION

The present invention provides an improved container assembly comprising an open-top container adapted to hold a medicament or other potentially dangerous substance and a lid selectively openable to allow access to the interior of the container. The lid is alternately positionable without detachment of the lid from the container between a first child-resistant position wherein the lid is latched and a second easy-open adult position wherein the lid is unlatched. In the invention, an improved lid connection assembly is employed which allows the lid to be rotated between a first lid position where one face of the lid is adjacent the container opening and the lid is latched, and a second lid position where the other face of the lid is adjacent the container opening and the lid is unlatched. Preferably, the lid connection assembly includes a skirt secured to the container about the open top thereof, with the lid operably coupled with the skirt. In use, the lid is opened and rotated 180° to change the container assembly configuration.

In more detail, a preferred closure assembly in accordance with the invention comprises a skirt section configured to be secured to the open top of a container and presenting an opening allowing access to the interior of the container, together with a lid moveable between a closed position covering the container opening, and an open position allowing access to the interior of the container through the opening. Connection apparatus operably couples the lid to the skirt section and permits movement of the lid about a first pivot axis between the container closed and container open positions thereof, and also includes structure permitting rotation of the lid about a second rotational axis transverse to the first pivot axis, while the lid remains connected to the skirt. In one embodiment, the reversible lid includes a rear section hingedly secured to the skirt, with a forward section rotationally mounted to the rear section. In an alternative embodiment, the connection structure is in the form of a ball joint between the lid and skirt.

Latching structure in the form of interengaging latching components on the lid and skirt is used to secure the lid in the closed position, when the closure assembly is in the child-resistant mode. Upon reversal of the lid to the adult position, no latching function is provided. Accordingly, the lid can be readily opened in this configuration.

DETAILED DESCRIPTION OF THE PREFERRED EMBODIMENTS

Embodiment of FIGS. 1-12

Figure 1:
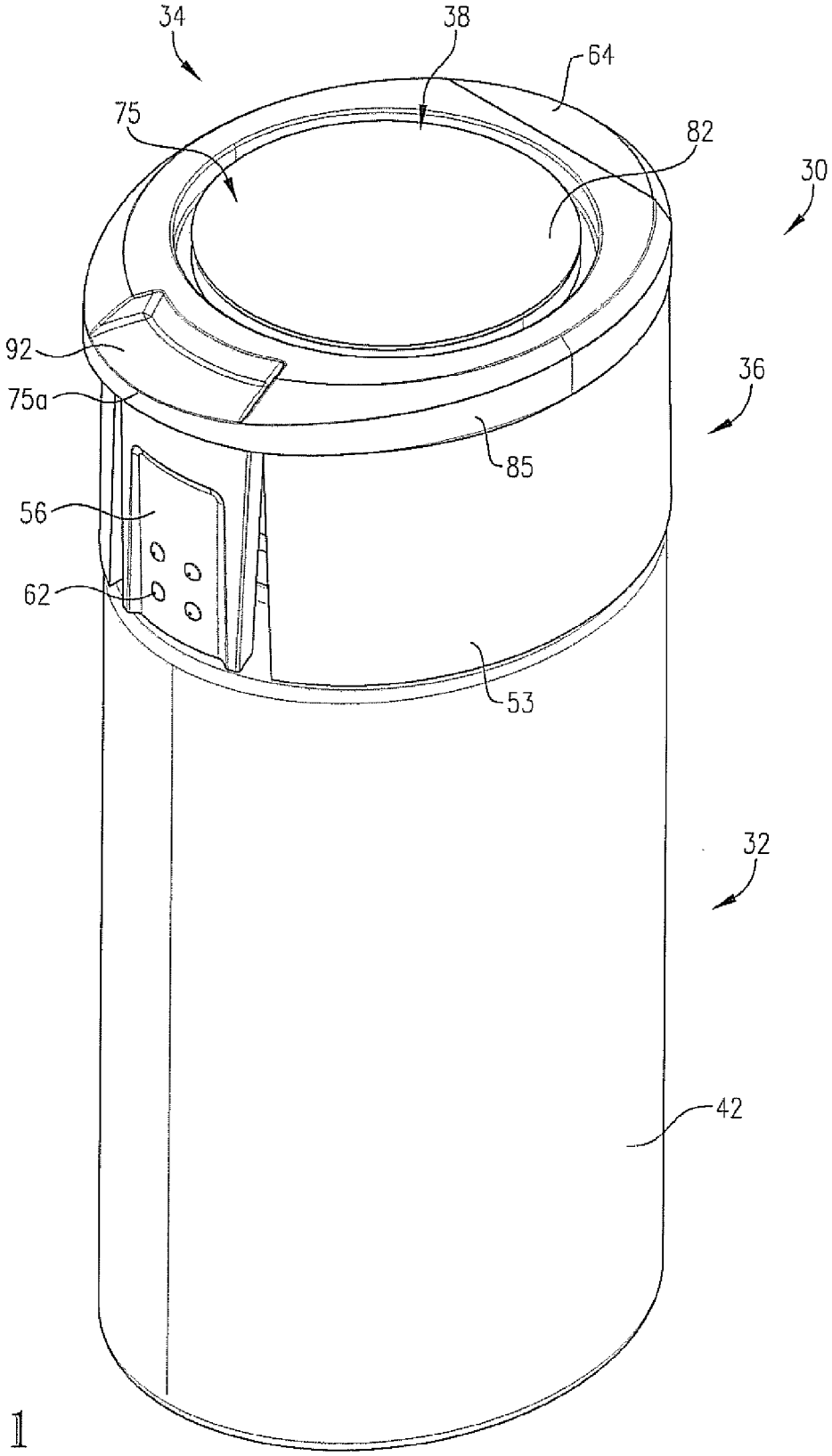
FIG. 1 is a perspective view of one embodiment of the invention, illustrating a dual-mode closure assembly secured to a container, with the closure assembly in the child-resistant orientation thereof.
Figure 2:
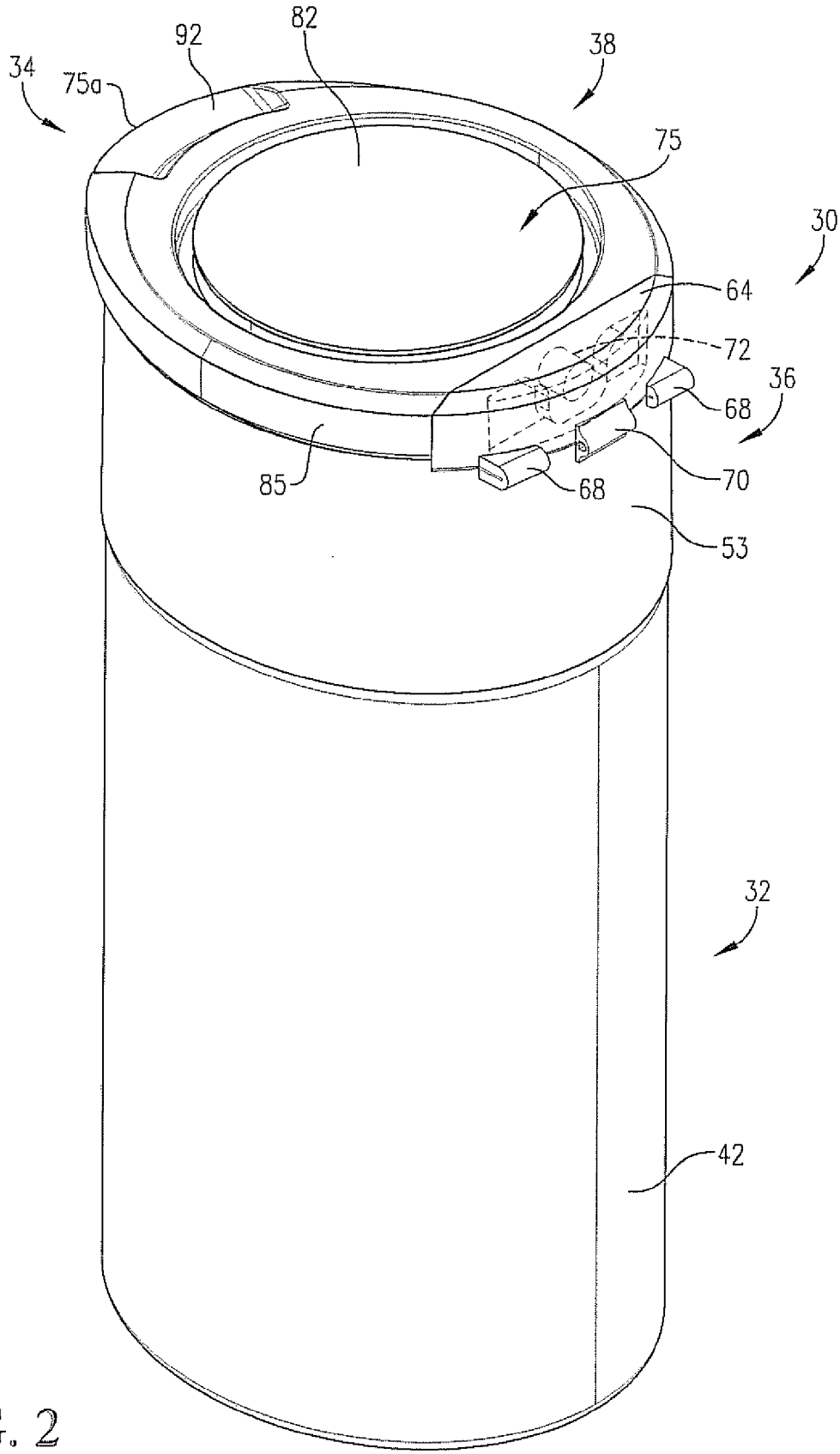
FIG. 2 is a perspective view similar to that of FIG. 1, but illustrating the hinge construction of the closure assembly.
Figure 3:
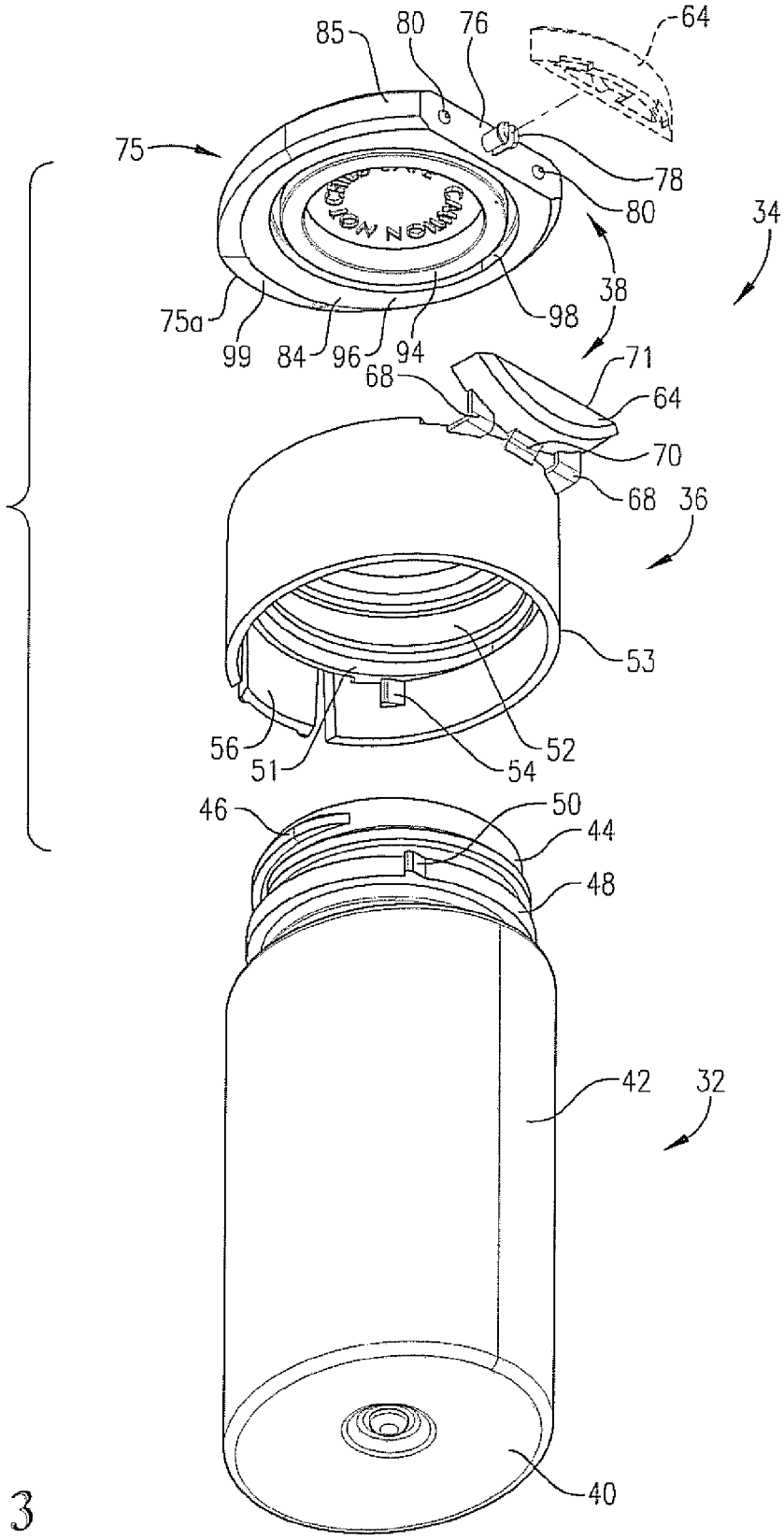
FIG. 3 is an exploded perspective view of the FIG. 1 embodiment.

Turning now to the drawings and particularly to FIGS. 1-5, a container assembly 30 is illustrated broadly including an open-top vial or container 32, with a closure assembly 34 secured to the open top of the container. The closure assembly has a skirt 36 and a reversible lid 38. A principal objective of the invention is the provision of a container assembly which can be readily shifted between a latched, child-resistant configuration and an unlatched, adult or non-child-resistant configuration.

In more detail, the container 32 is integrally formed of an appropriate synthetic resin material and has a base 40, an upstanding, continuous sidewall 42, and a reduced diameter neck 44 defining the open top of the container. The neck 44 is provided with outwardly extending spiral threading 46 as well as a lowermost circular rib 48 having a pair of opposed, outwardly extending abutments 50. The container 32 is especially for holding medicaments such as pills or capsules, but could be used for holding any substance potentially injurious to children.

The skirt 36 is designed to be threaded onto neck 44, and is provided with a depending, internal sidewall 51 having internal threading 52 which mates with threading 46. A pair of opposed stops 54 are provided beneath the threading 52. The overall skirt 36 further includes an outer depending sidewall 53 which defines the outer perimeter of the skirt 36. The skirt 36 also includes an annular upper wall 55 terminating in an inboard, upstanding, circular sealing wall 55*a*. A plate-like latching component 56 is secured to the internal sidewall 51 by means of a medial connector 58 (FIG. 6) which allows the component 56 to pivot or rock to a limited degree about the connector. The upper edge of the component 56 is provided with a pair of laterally spaced apart, inwardly extending latching elements 60, whereas the lower extent of the component is notched and provided with knurl projections 62. As illustrated, annular wall 55 is relieved at 63 so as to allow the upper end of component 56 and latching elements 60 to move inwardly and outwardly about connector 58.

The lid 38 includes two basic components, namely a hinged section 64 and a reversible body 75. The section 64 is attached to the upper edge of outer skirt sidewall 53 opposite latching component 56 by means of three flexible hinge members, i.e., a pair of outer hinge members 68 and a central hinge member 70. The section 64 is frustocircular in plan configuration and has a substantially flat inboard surface 71. The surface 71 has a central opening 72 as well as a pair of side marginal concavities 74.

Lid 38 is somewhat oval-shaped and has a rear, flat surface 76 configured to mate with surface 71 of section 64. To this end, the surface 76 has a central, bifurcated pin 78 as well as a pair of detent projections 80. The pin 78 is designed to fit within opening 72 with the detent projections 80 being located within the concavities 74. The lid 38 has a body 75 which is designed to mate with upstanding skirt wall 55*a* in order to close container 32. The body 75 further has a projecting portion 75*a* which extends outboard over the latching component 56. The body 75 presents a pair of differently configured first and second opposed faces 82 and 84, and an outer defining sidewall 85.

The face 82 includes a central section 86 and an outer segment 88 cooperatively defining circular recess 90. The sidewall 85 is flush with skirt outer sidewall 53 around the majority of the periphery thereof, but is outboard of the sidewall 53 at the region of portion 75*a*. A cut-out or notch 92 is provided in face 82 at the region of projecting portion 75*a*, as best seen in FIG. 1.

Figure 4:
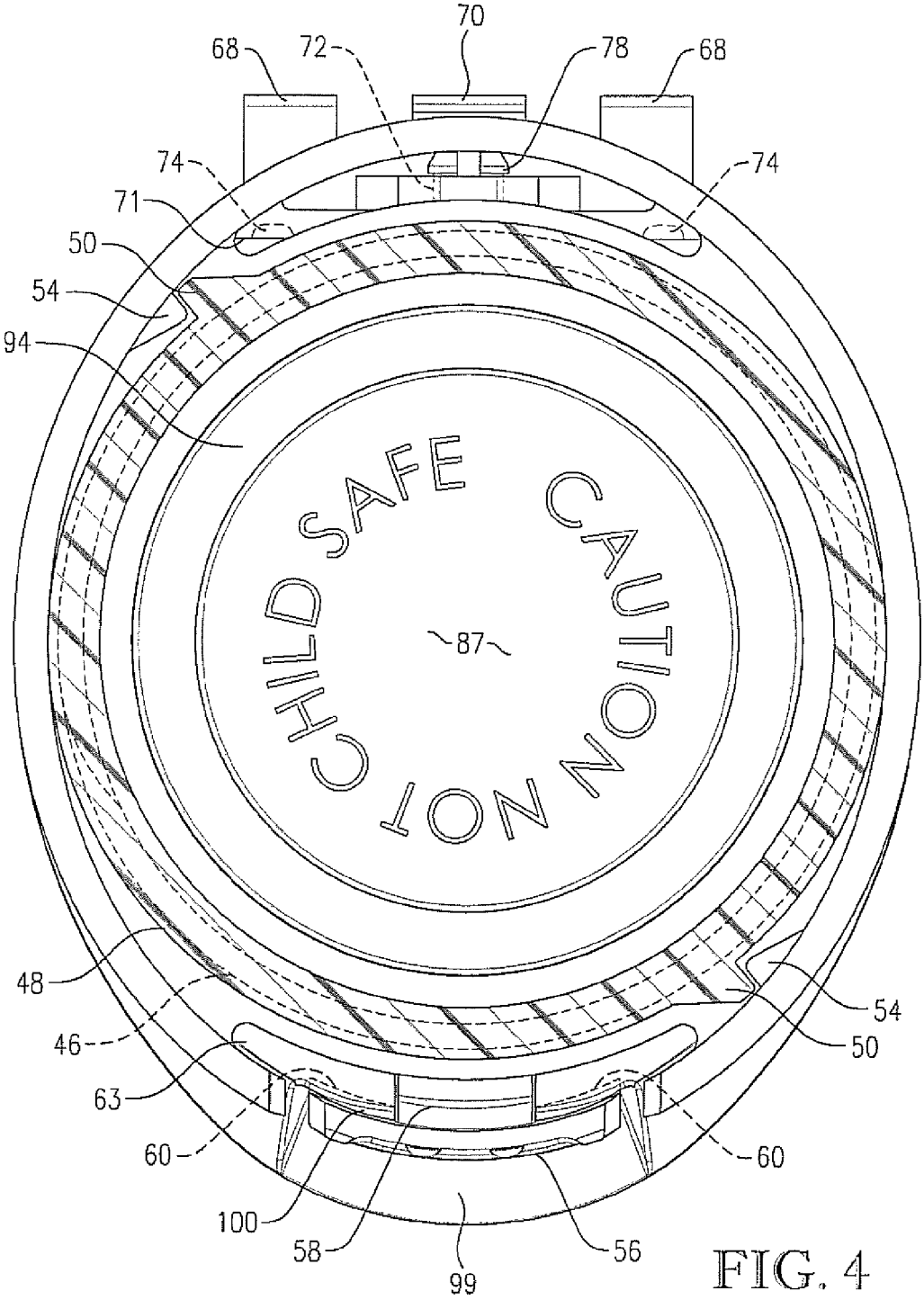
FIG. 4 is a sectional view of the FIG. 1 embodiment, illustrating the internal design of the closure assembly.
Figure 5:
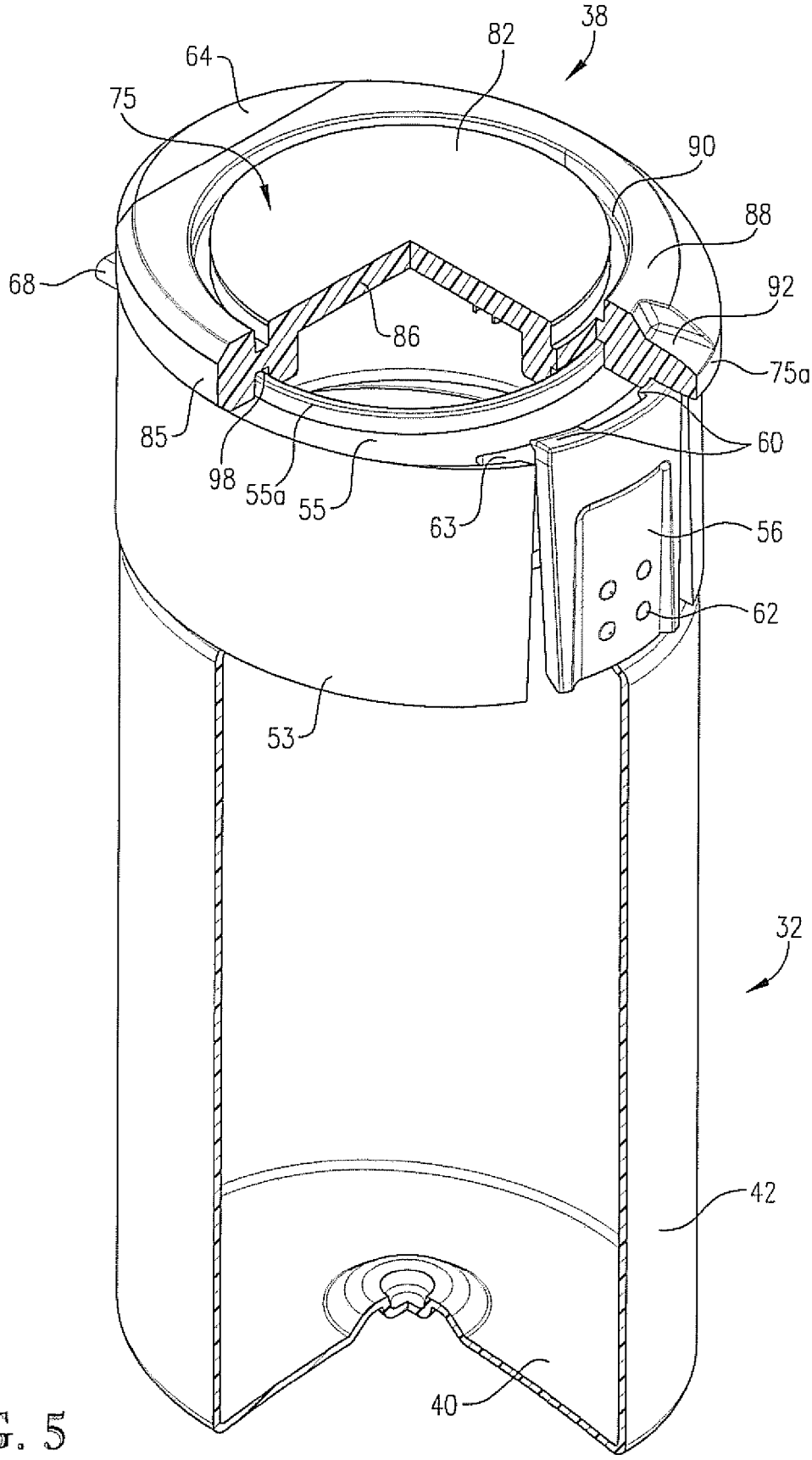
FIG. 5 is a perspective view in partial vertical section and with parts broken away, and illustrating the closure assembly latch.
Figure 11:
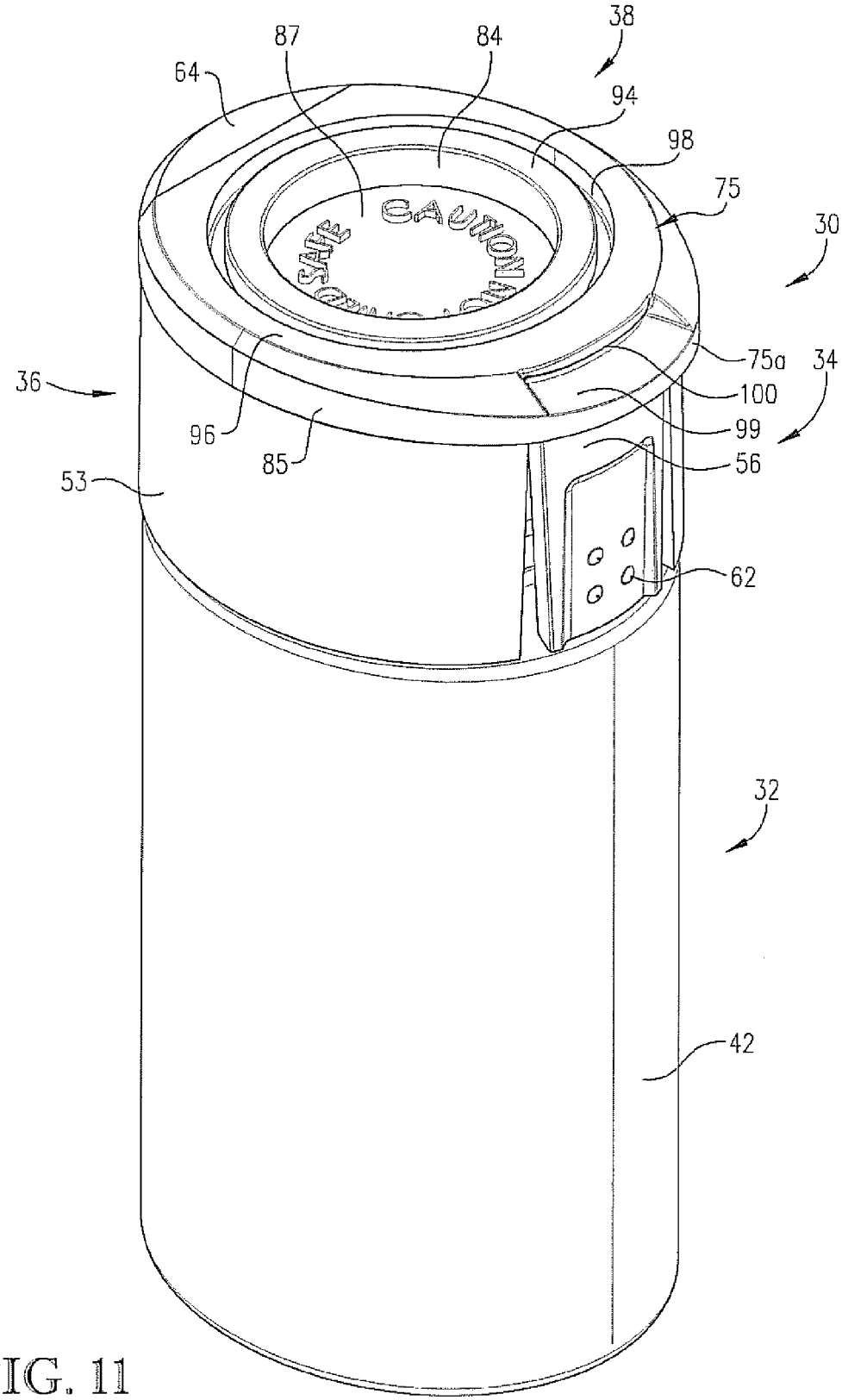
FIG. 11 is a perspective view of the lid rotated as depicted in FIG. 10 and pivoted downwardly to the closed, non-child-resistant orientation of the closure assembly.
Figure 12:
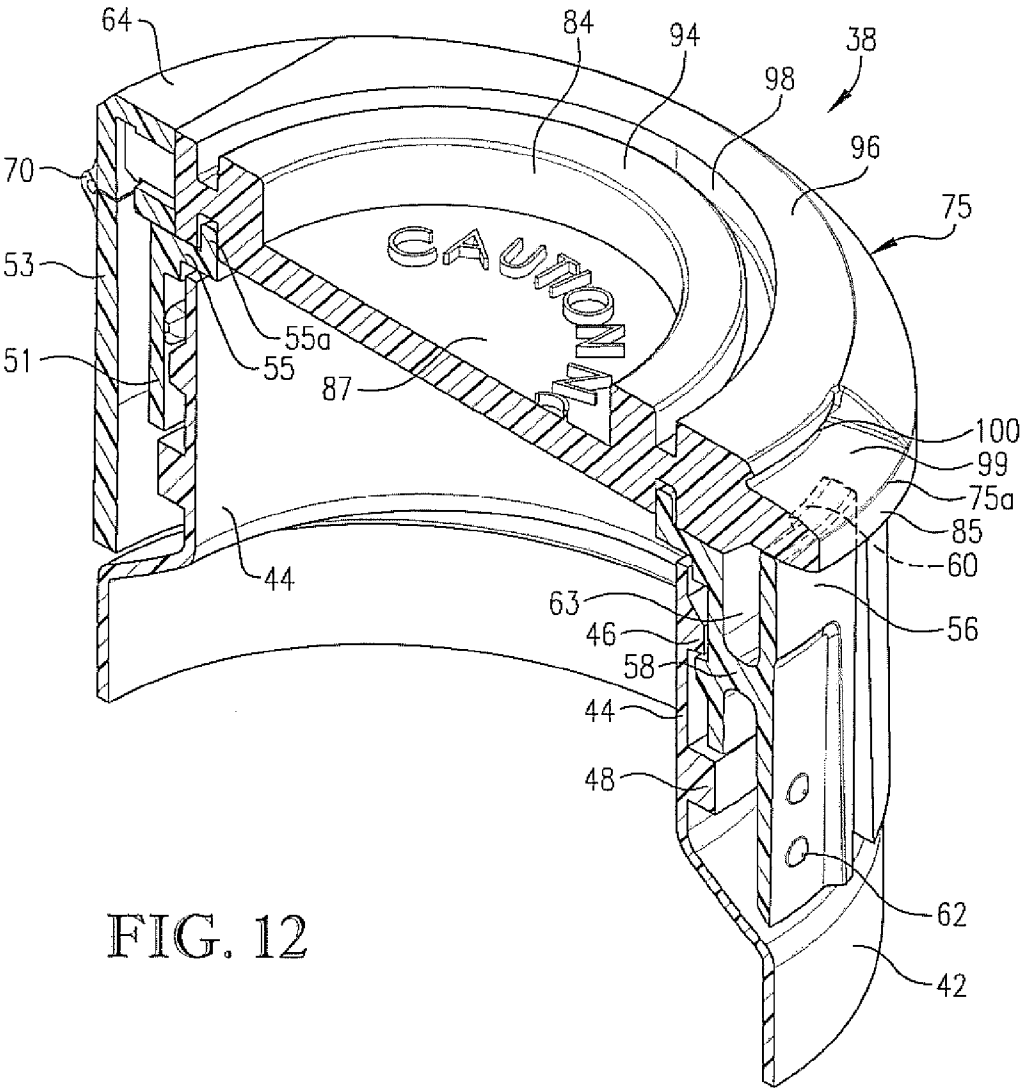
FIG. 12 is an enlarged, perspective view in vertical section depicting the closure of the lid in the non-child-resistant orientation of the closure assembly, and permitting easy opening of the lid without the need for de-latching.
Figure 13:
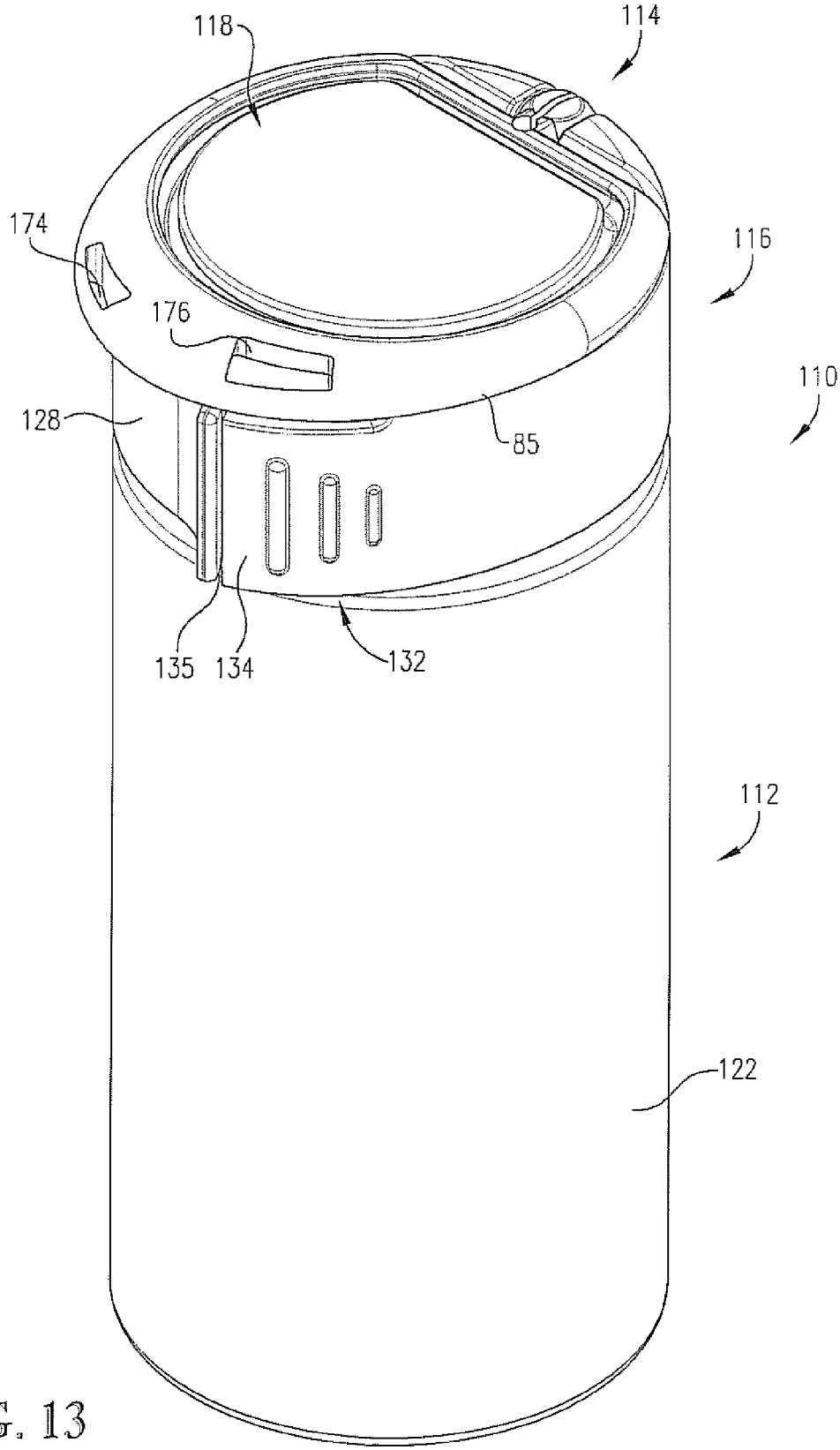
FIG. 13 is a perspective view of another embodiment of the invention, illustrating a dual-mode closure assembly secured to a container, with the closure assembly in the child-resistant orientation thereof.

As shown in FIGS. 11 and 12, opposed face 84 presents an inner annular segment 94 as well as an outer segment 96 merging into sidewall 85. A circular recess 98 is defined between the segments 94 and 96. The face 84 has a notch 99 and an inner latching slot 100 at the overhang region 75*a* which is adapted to mate with the latching elements 60 of component 56. As illustrated in FIG. 4, the surface of body 75 within inner segment 94 bears the legend "CAUTION NOT CHILD SAFE." This legend may be embossed as shown or the central section 87 bounded by inner annular segment 94 may be substantially filled in with resin (similar to face 82) and the legend imprinted thereupon.

Figure 6:
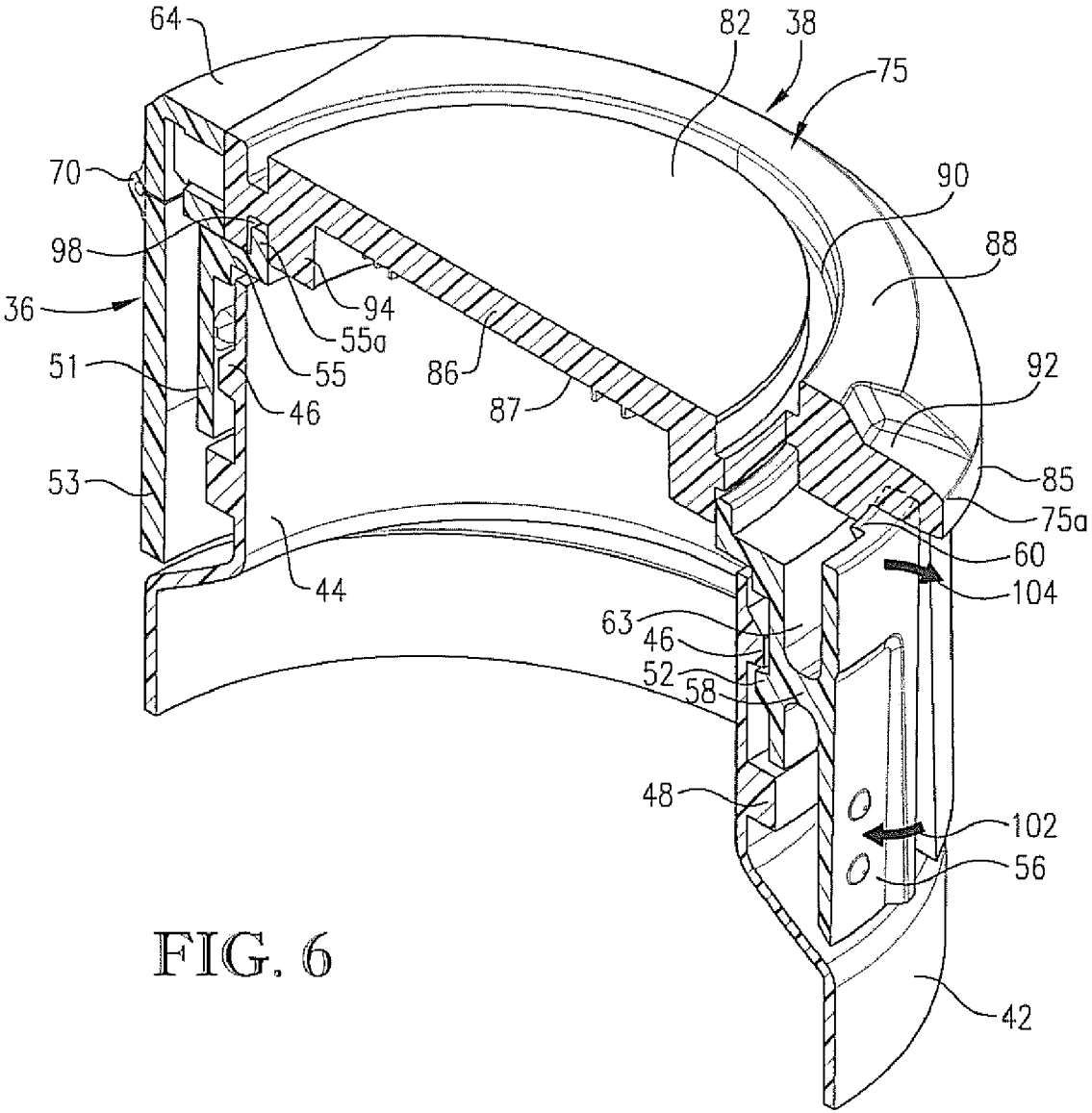
FIG. 6 is an enlarged, perspective view in vertical section depicting the initial step involved in opening of the latch.
Figure 7:
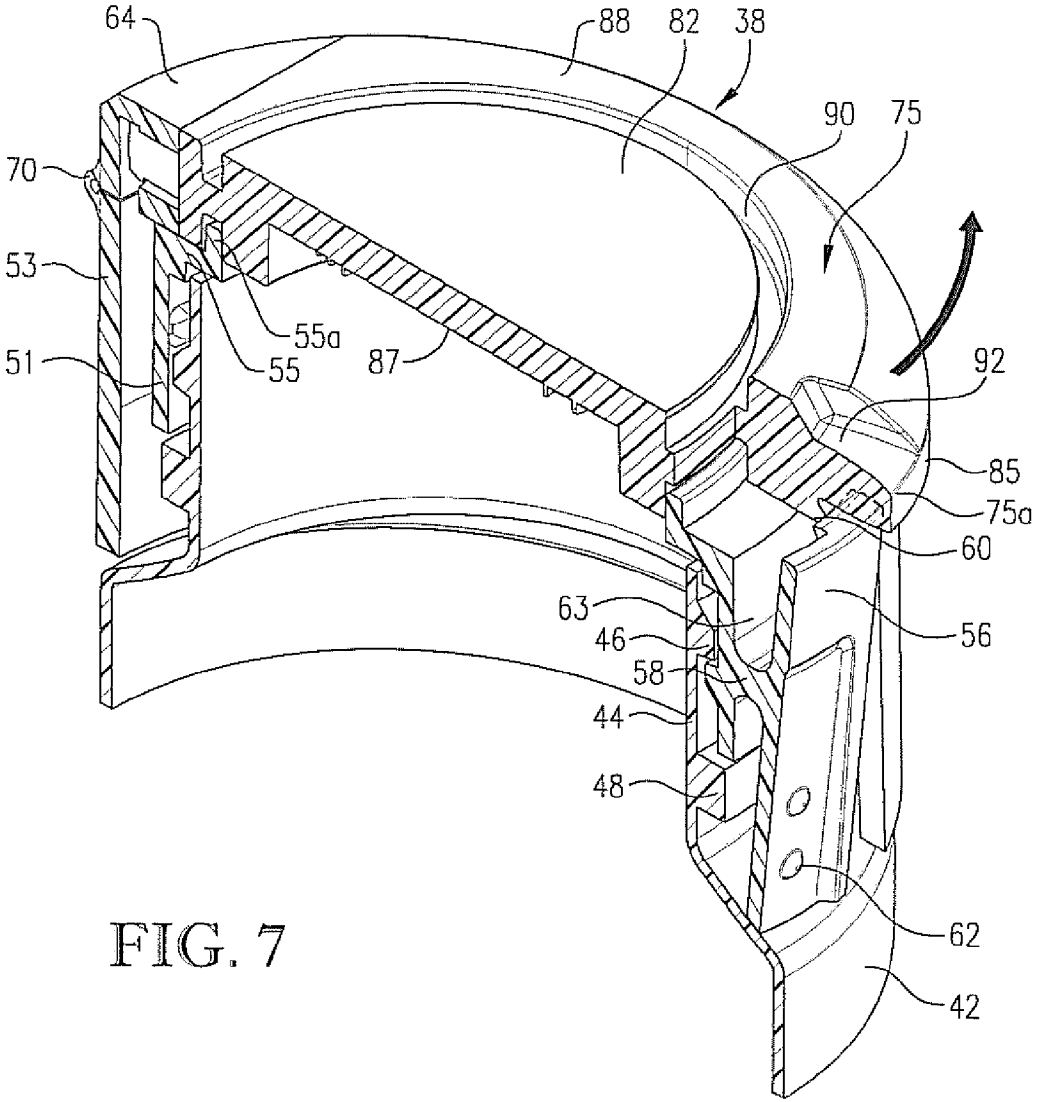
FIG. 7 is an enlarged, perspective view in vertical section illustrating the next step in opening of the latch.
Figure 8:
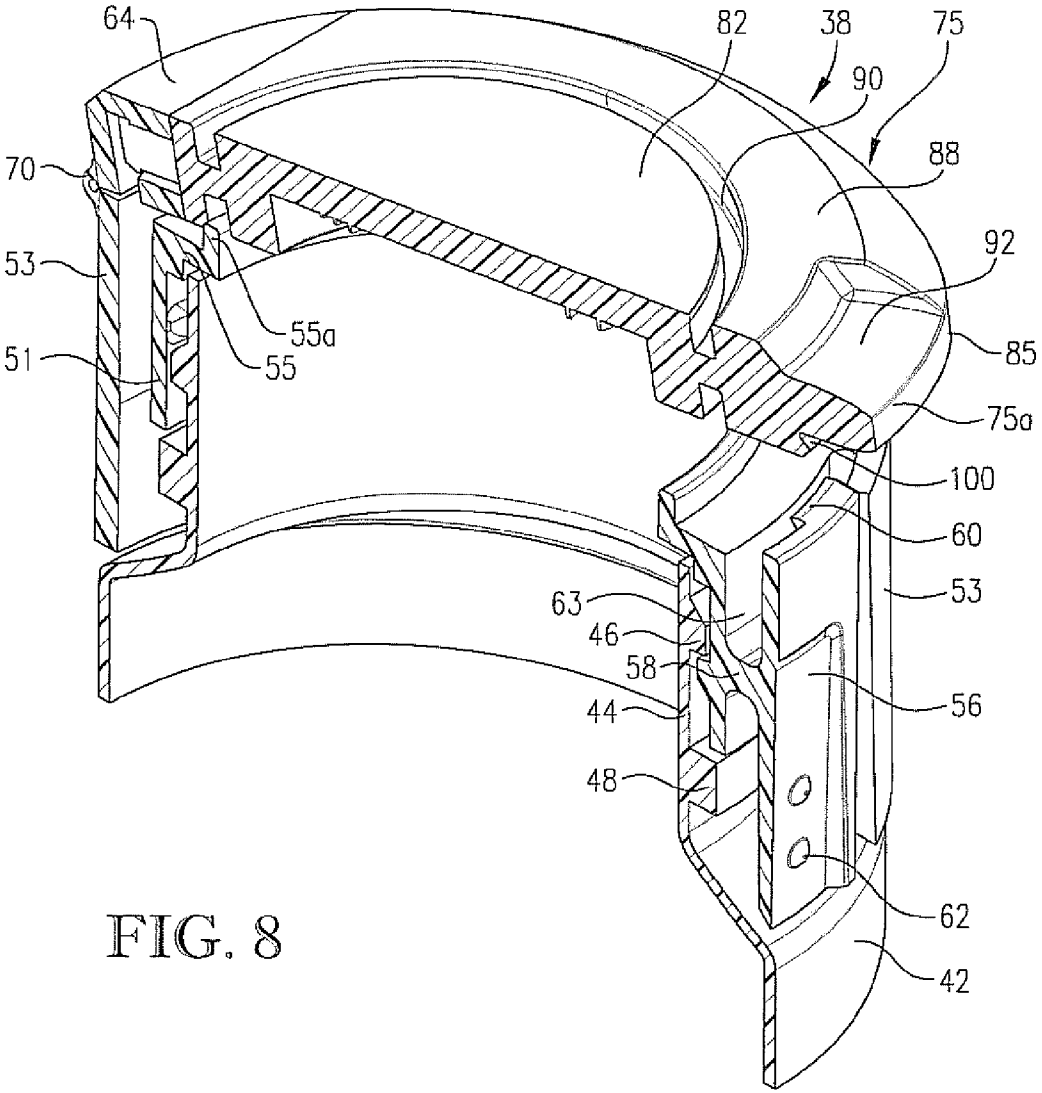
FIG. 8 is an enlarged, perspective view in vertical section illustrating the latch fully opened and allowing the closure assembly lid to be pivoted upwardly.

The child-resistant orientation of closure assembly 34 is illustrated in FIG. 1-8, with the first face 82 of lid 38 showing upwardly, and with second face 84 downwardly, facing the open top of container 32. In this orientation, the inner wall 55*a* of skirt 36 is received within the recess 98 of second face 84, and the latching elements 60 of component 56 are received within the slot 100. This serves to lock the lid 38 in place and makes it difficult for a child to open the container assembly 30. However, an adult can readily open the container by pressing the component 56 inwardly at the area of the knurl projections 62. This serves to rock or pivot the upper end of the component 56 and latching elements 60 outwardly, away from the inner sidewall 51. Such action is illustrated in FIG. 6 by arrow 102 illustrating inward movement of the lower region of component 56 and by arrow 104 illustrating the corresponding outward movement of the latching element 60. At this point the user can apply upward thumb pressure to the area of notch 99 in order to pivot the lid 38 about the hinge members 68 and 70 (see FIGS. 7 and 8). The lid 38 can then be fully opened in the usual fashion to allow access to the contents within container 32.

Figure 9:
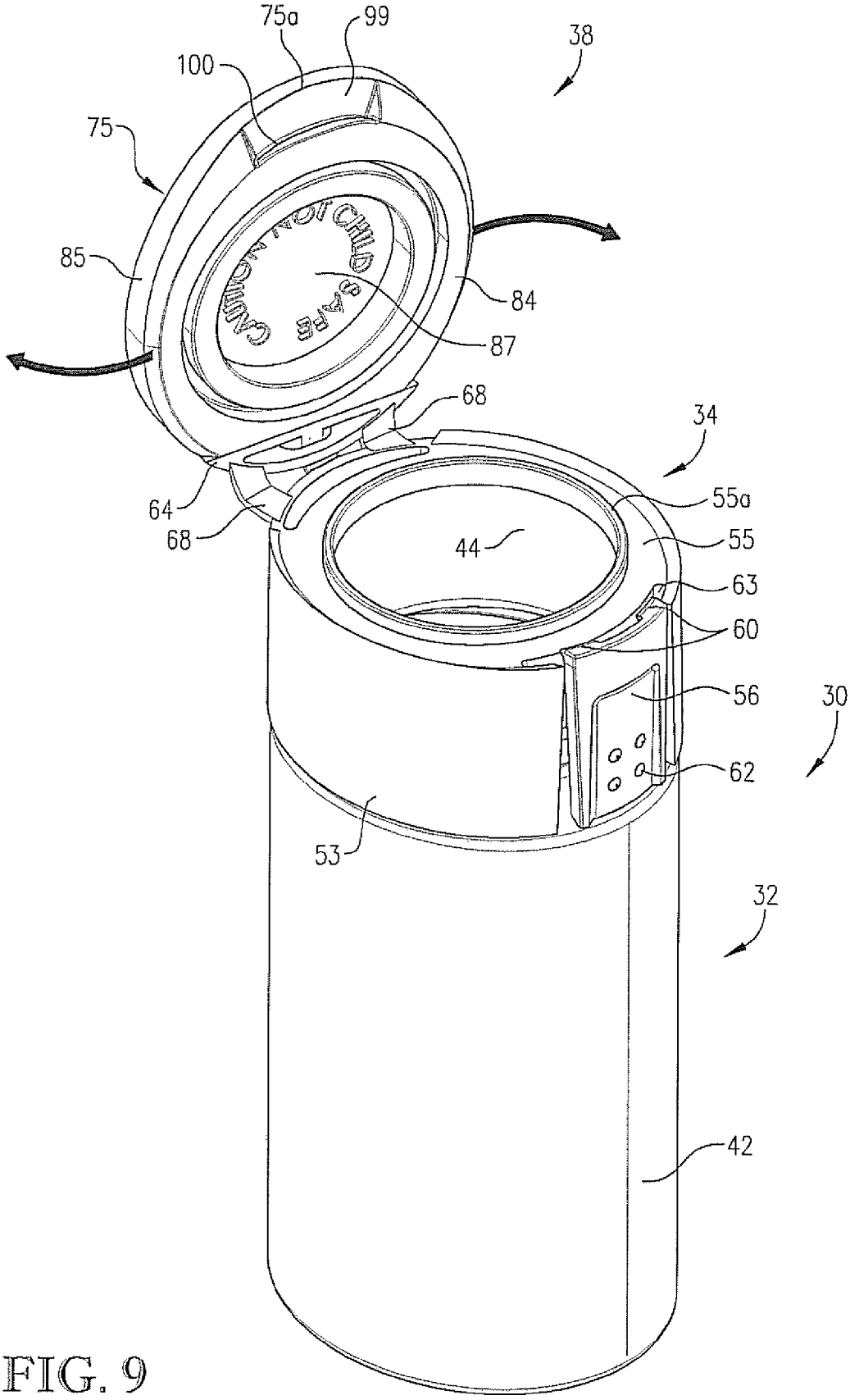
FIG. 9 is a perspective view illustrating the lid of the closure assembly fully pivoted open in an orientation permitting rotation of the lid to the non-child-resistant orientation of the closure assembly.
Figure 10:
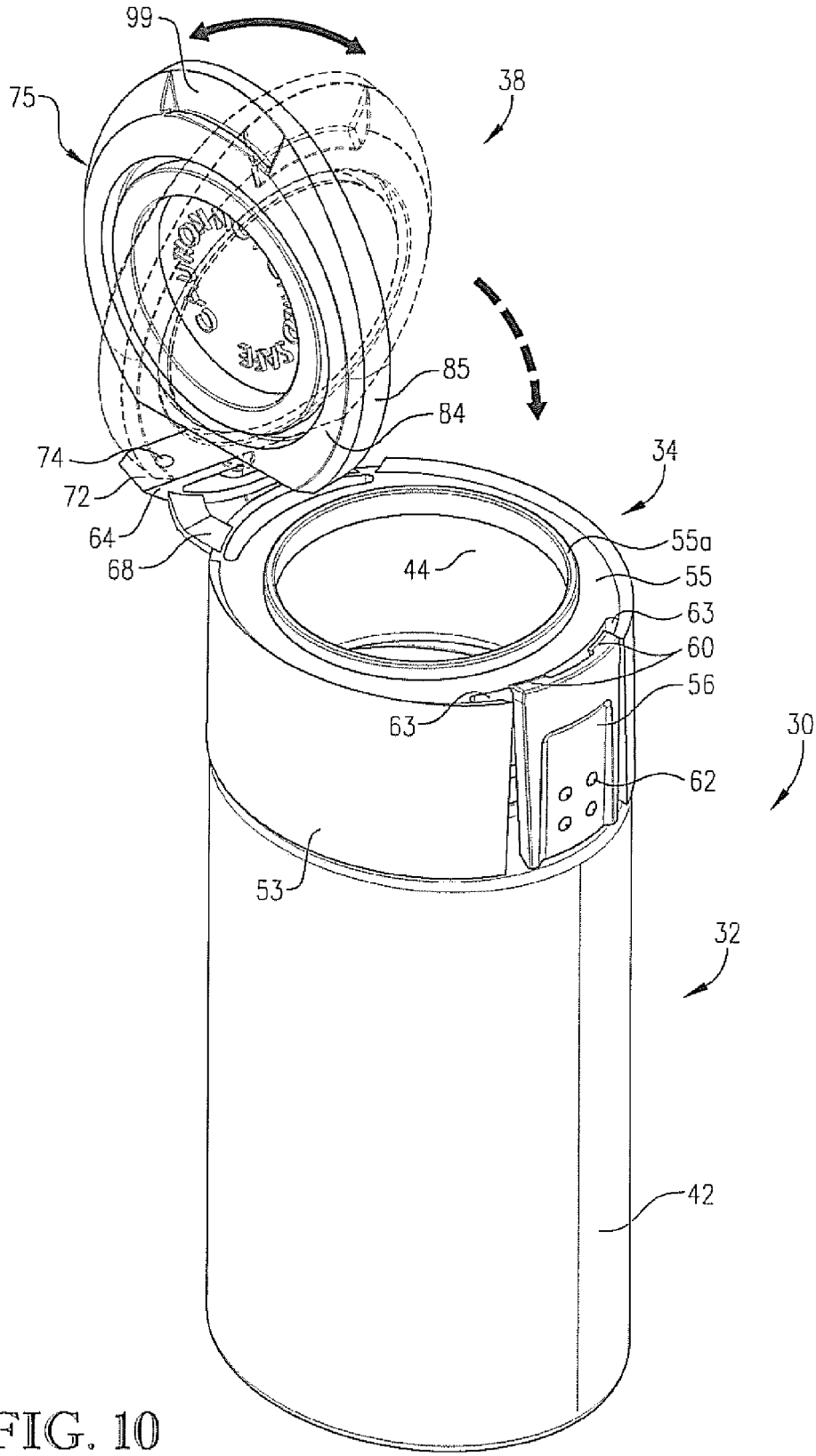
FIG. 10 is a perspective view similar to that of FIG. 9, and illustrating rotation of the lid to the non-child-resistant orientation of the closure assembly.

If it is desired to convert the container assembly 30 to the adult orientation thereof, it is only necessary to open the lid 38 as described, followed by rotation of the reversible body 75 about the axis of pin 78 as shown in FIGS. 9 and 10. This can be readily done manually, after the resistance of the detent projections 80 is overcome. Such rotation is continued until the face 82 is adjacent the open top of container 32, and the detent projections 80 are again located within the concavities 74. The now-reversed lid 38 can then be closed simply by pivoting the lid downwardly until the sealing wall 55*a* is received within the recess 90 of first surface 82. It will be observed that in this orientation that there is no latching function because there is no structure engaging the latching elements 60. The warning notice of second face 84 is readily visible in this orientation, as illustrated in FIG. 11. Opening of the lid 38 requires only upward thumb pressure to the projecting portion 75*a*.

It will thus be seen that the lid 38 is coupled to skirt 36 about a first pivot axis defined by the hinge members 68 and 70, and is further rotatable about a second rotational axis defined by pin 78 which is transverse to the first pivot axis. This permits the changeover between the child-resistant and adult configurations of the container assembly 30, while the lid 38 remains connected to skirt 36. As such, there's no possibility of loss of the lid during the changeover.

Embodiment of FIGS. 13-22

This embodiment of the invention is conceptually similar to the first embodiment in that a reversible lid is provided permitting a rapid, easy changeover between child-resistant and adult orientations. The principal differences between the first embodiment and that of FIGS. 13-22 is in the specific design of the closure assembly.

Figure 14:
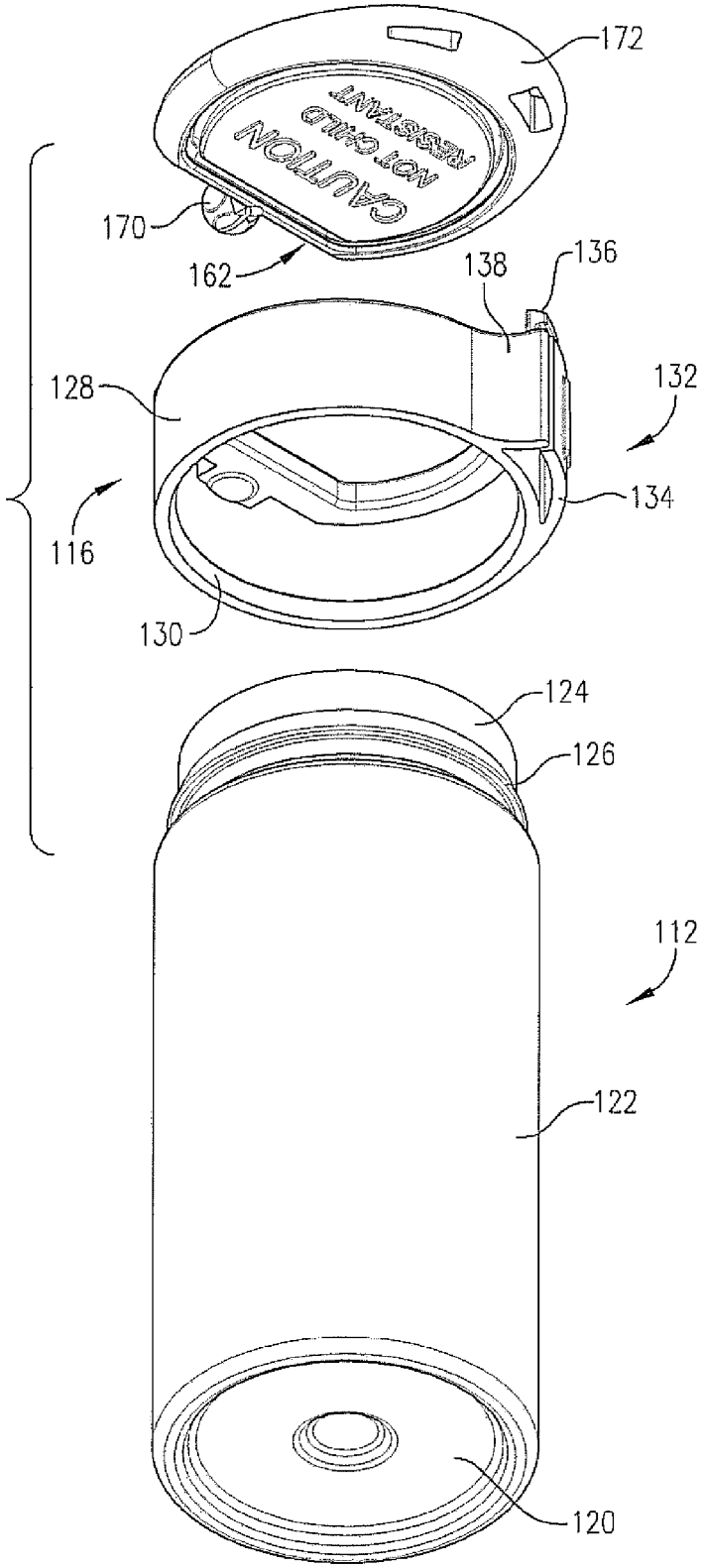
FIG. 14 is an exploded perspective view of the FIG. 13 embodiment.
Figure 15:
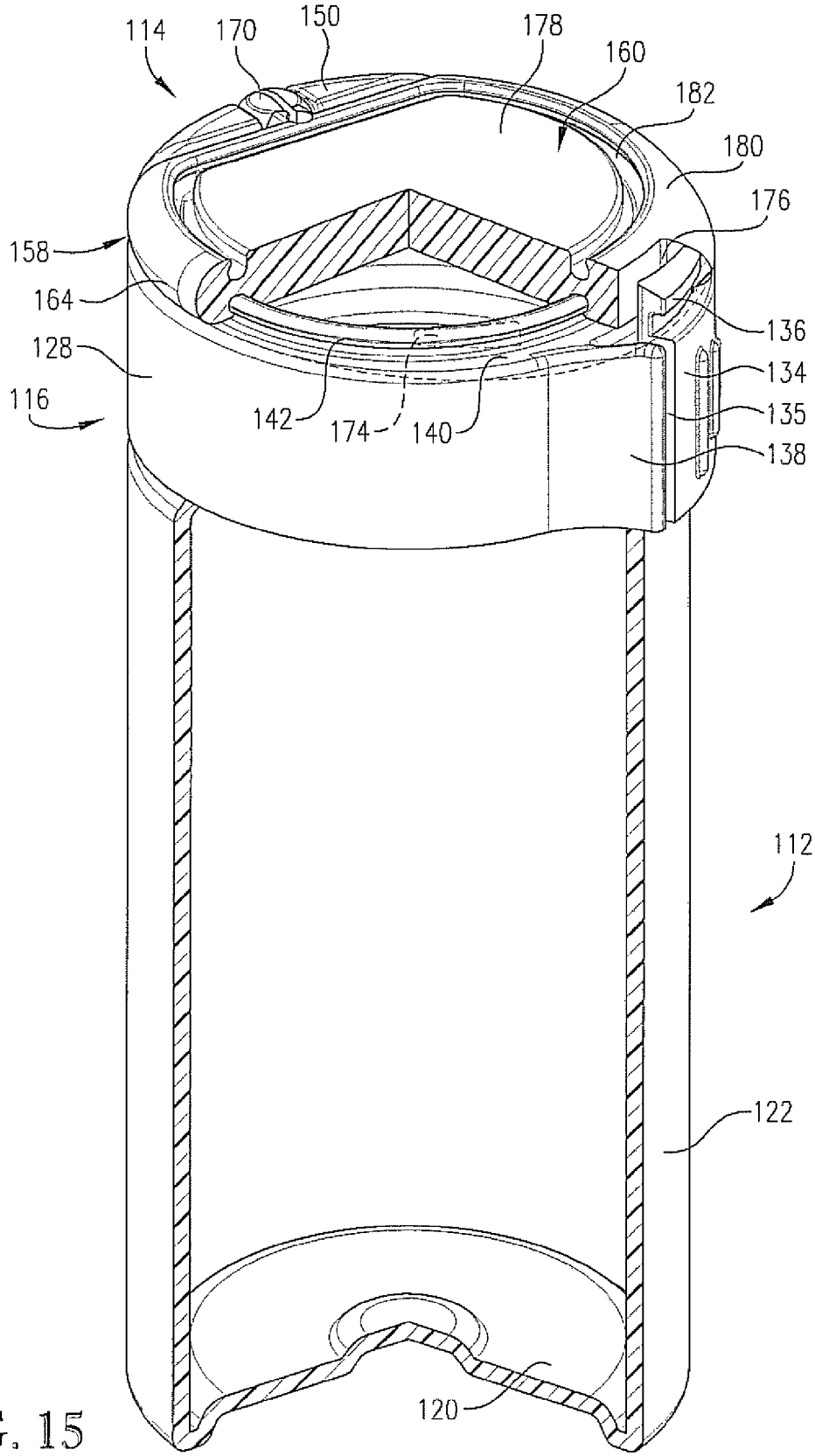
FIG. 15 is a perspective view in partial vertical section and with parts broken away, and illustrating the closure assembly latch in the FIG. 13 embodiment.

In particular, a container assembly 110 is provided including a container 112 and closure assembly 114, the latter including skirt 116 and reversible lid 118. As illustrated in FIG. 14, the container 112 is integrally formed of an appropriate synthetic resin material and has a base 120, a continuous circular sidewall 122, and a reduced diameter neck 124. The neck 124 has a continuous, outwardly extending connection lip 126 (see FIG. 16).

The skirt 116 includes a primary sidewall 128 of circular configuration, with an inwardly extending lip 130 on the inner surface thereof, so that the skirt 116 can be snapped into place and held on neck 124 by engagement between the lips 126 and 130. The skirt 116 also has a latching assembly 132 including an arcuate latching wall 134 extending outwardly from primary sidewall 128 and having a free edge 135 and an upwardly extending locking lug 136 of inverted, L-shaped configuration. The assembly 132 also has a short, outwardly projecting mating wall 138 which extends into close proximity with the free edge 135 of latching wall 134.

Figure 19:
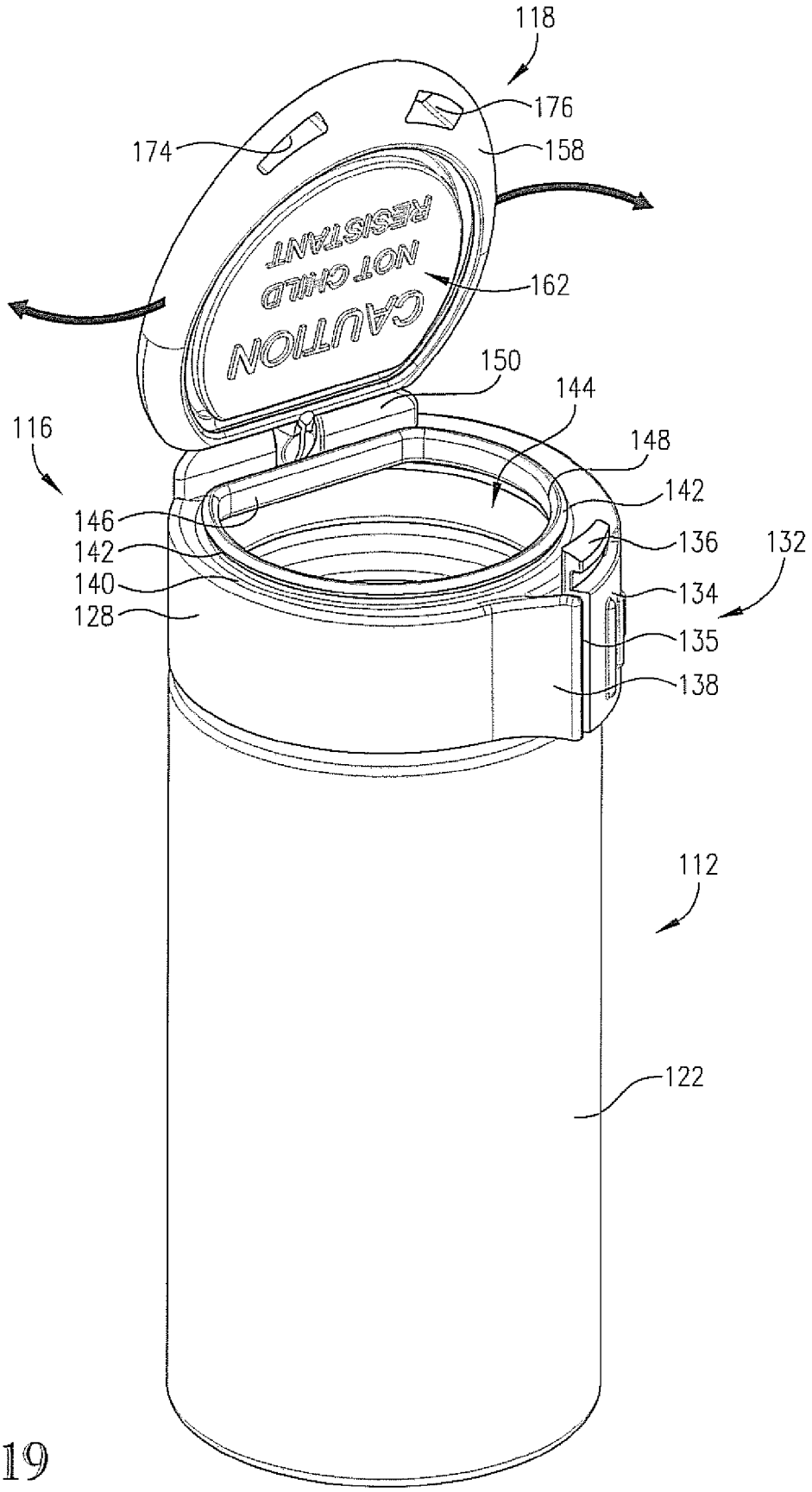
FIG. 19 is a perspective view illustrating the lid of the closure assembly fully pivoted open in an orientation permitting rotation of the lid to the non-child-resistant orientation of the closure assembly.
Figure 20:
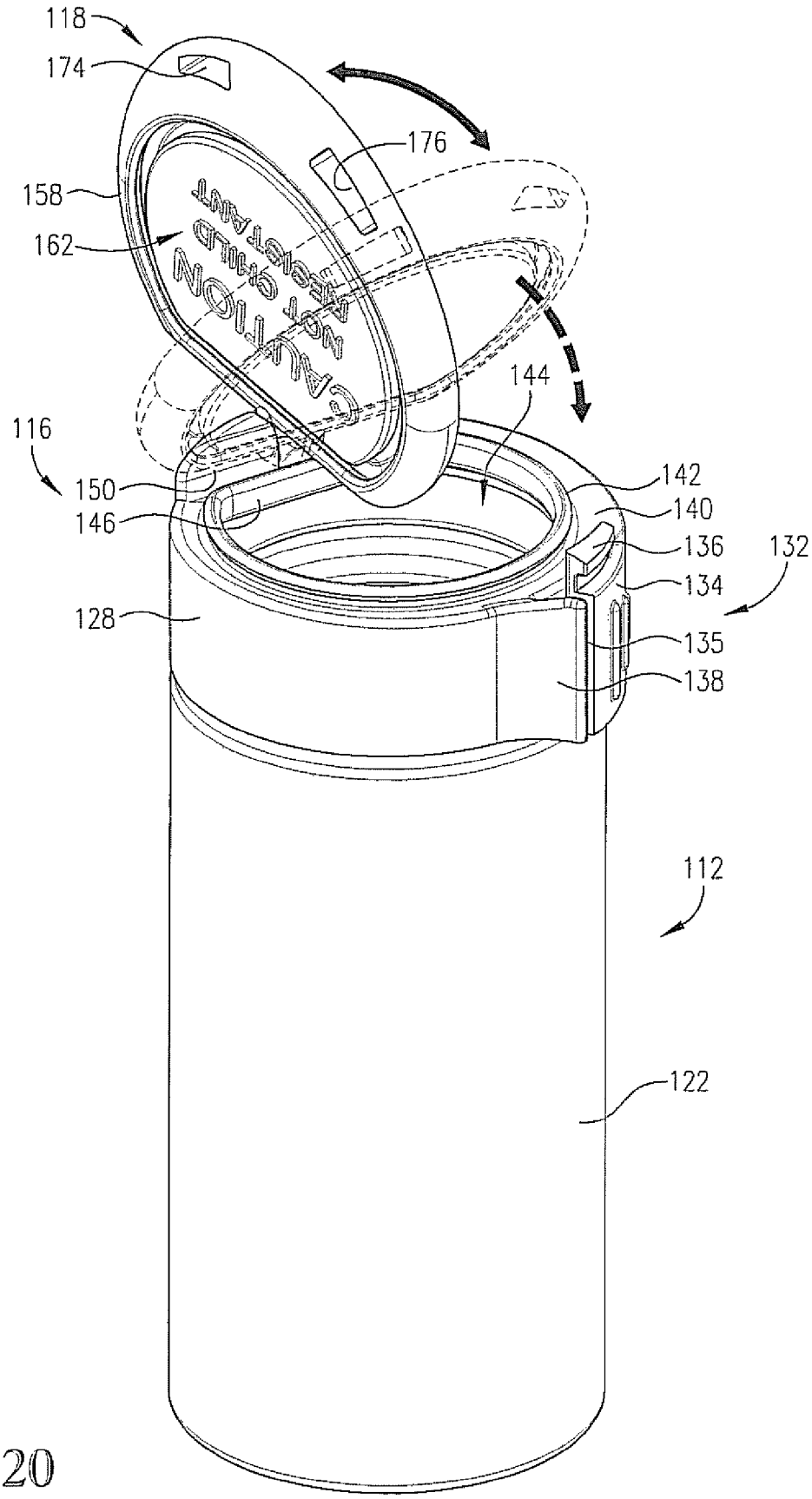
FIG. 20 is a perspective view similar to that of FIG. 9, and illustrating rotation of the lid to the non-child-resistant orientation of the closure assembly.
Figure 21:
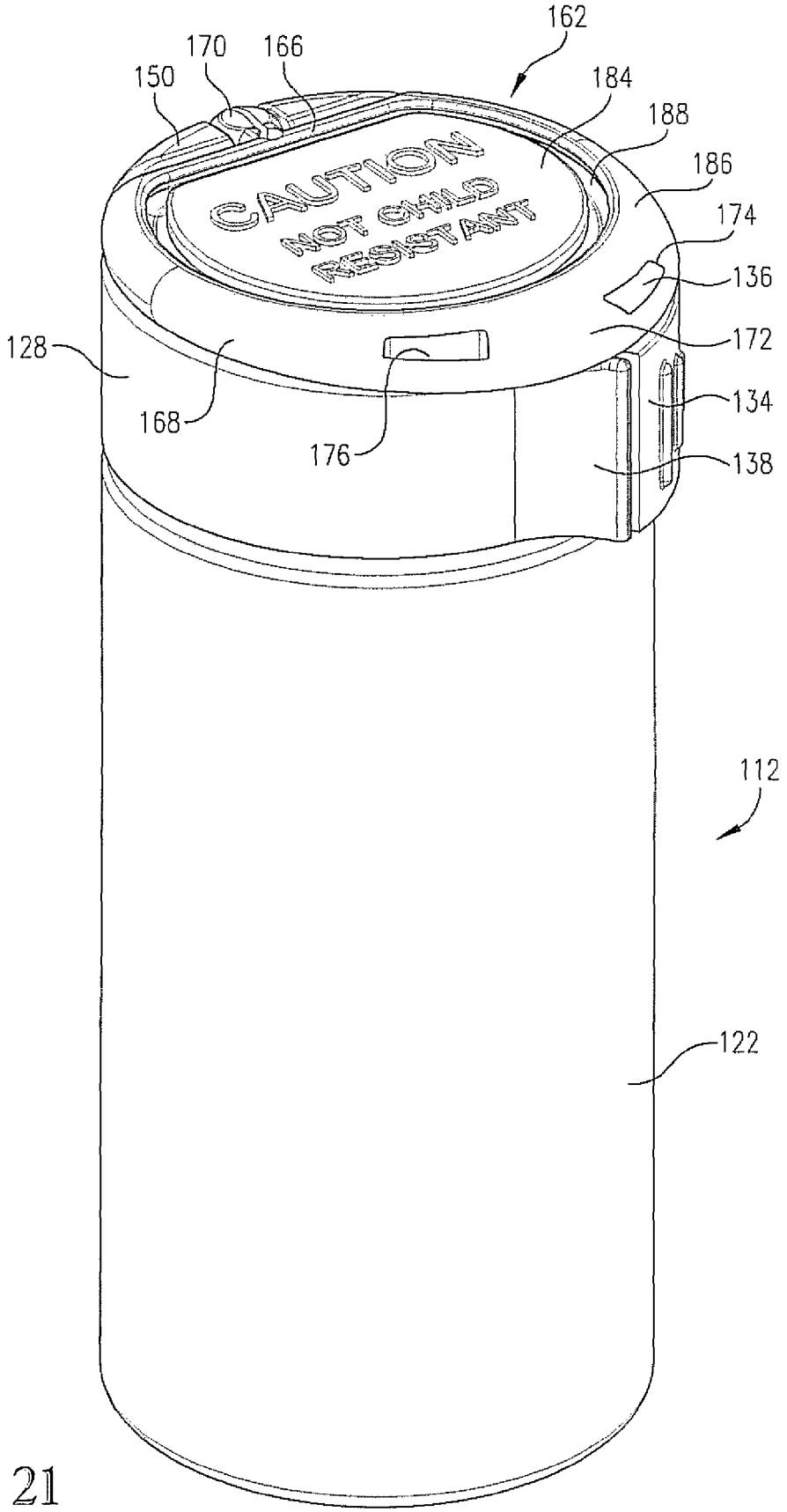
FIG. 21 is a perspective view of the lid rotated as depicted in FIG. 20 and pivoted downwardly to the closed, non-child-resistant orientation of the closure assembly.
Figure 22:
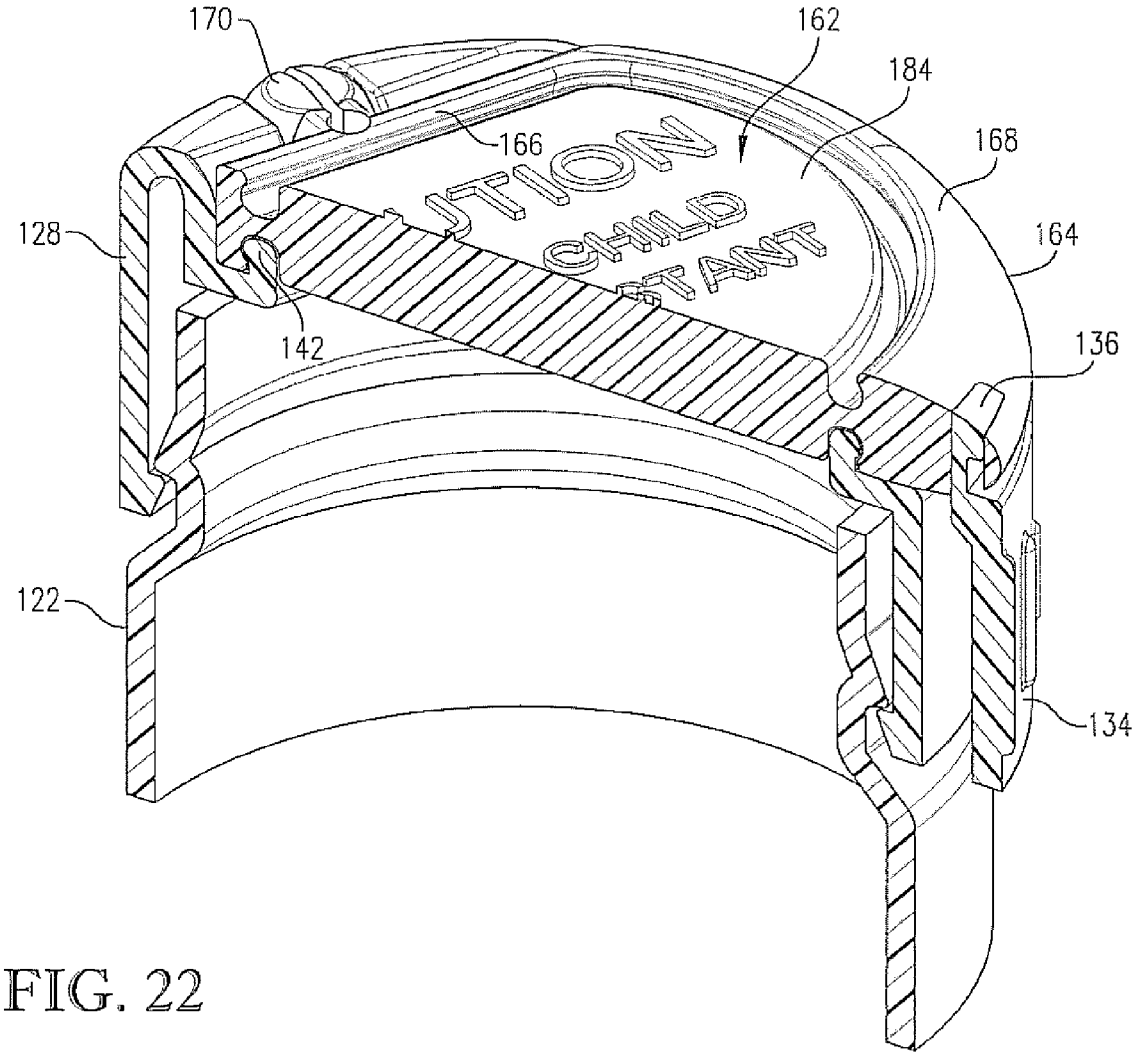
FIG. 22 is an enlarged, perspective view in vertical section depicting the closure of the lid in the non-child-resistant orientation of the closure assembly, and permitting easy opening of the lid without the need for de-latching.

The upper surface of skirt 116 includes an annular top wall 140 and an innermost, upstanding sealing wall 142 defining an access opening 144 (see, FIG. 19). It will be observed that the sealing wall 142 includes a generally straight rear section 146 and an arcuate forward section 148. A lid mount 150 extends upwardly from top wall 140 and merges with primary sidewall 128, adjacent the rear section 146 of wall 142, and directly opposite the latching assembly 132. The mount 150 includes a central opening 152 defined by side panels 154, the latter each having a frustospherical depression 156 formed therein.

The lid 118 includes a main body 158 presenting first and second opposed faces 160, 162 with an outer defining sidewall 164. The main body 158 has a generally straight rear section 166 and a forwardly projecting arcuate section 168. A bifurcated mounting ball 170 extends outwardly from the rear section 166. The arcuate section 168 includes a front portion 172 disposed to overlie the latching assembly 138, and has a pair of through-slot openings 174 and 176 formed therein, with the slot opening 176 having a recessed latching surface 177.

The first face 160 has a central segment 178 and an outboard shoulder 180 merging with sidewall 164. The segment 178 and shoulder 180 cooperatively define a recess 182 adapted to receive sealing wall 142. The second face 162 is similarly configured, with a central segment 184 and shoulder 186 cooperatively defining recess 188, again shaped to receive sealing wall 142. The central segment 184 bears the inscription "CAUTION NOT CHILD RESISTANT."

The assembly 110 is illustrated in the child-resistant configuration in FIGS. 13-16. In this orientation, the first surface 160 faces upwardly and second surface 162 is adjacent the open top of container 112. The mounting ball 170 is received within the opening 152, such that the spherical sidewalls of the ball are received by the depressions 156. Additionally, the sealing wall 142 is received within recessed 182 of second face 162, and the locking lug 136 is in latching engagement with the surface 177 of through-slot 176, in order to secure lid 118 in place.

Figure 16:
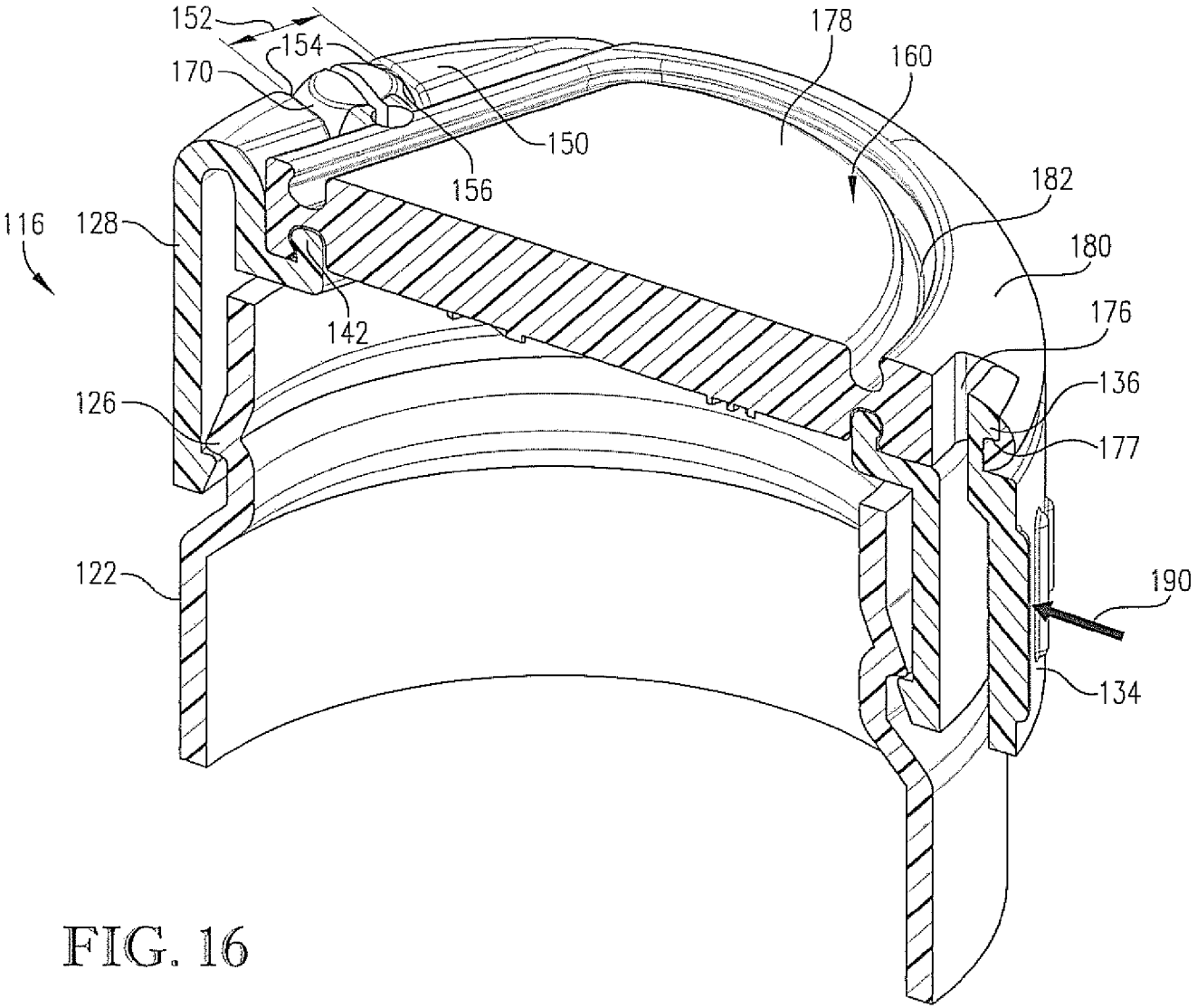
FIG. 16 is an enlarged, perspective view in vertical section depicting the initial step involved in opening of the latch.
Figure 17:
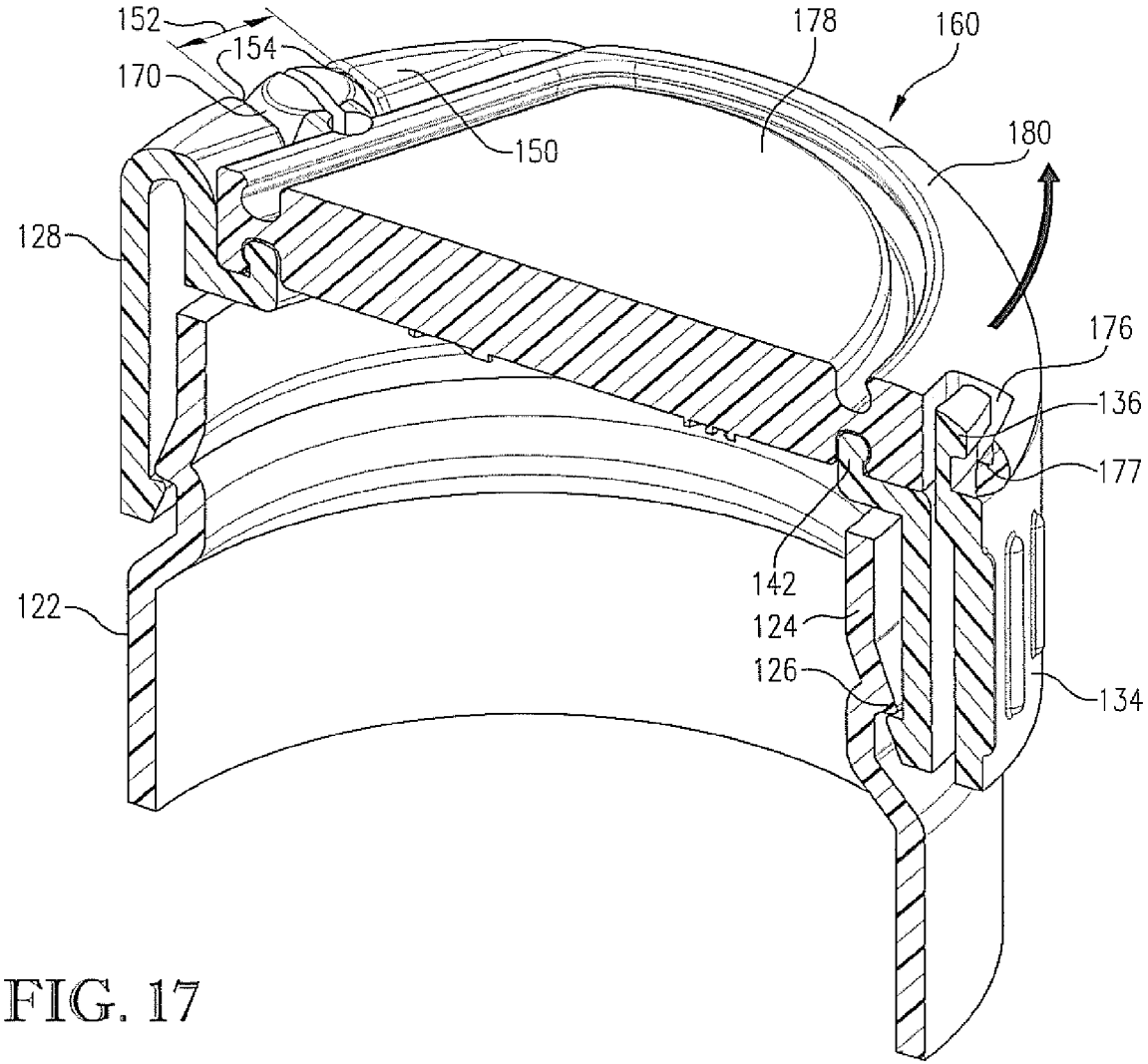
FIG. 17 is an enlarged, perspective view in vertical section illustrating the next step in opening of the latch.
Figure 18:
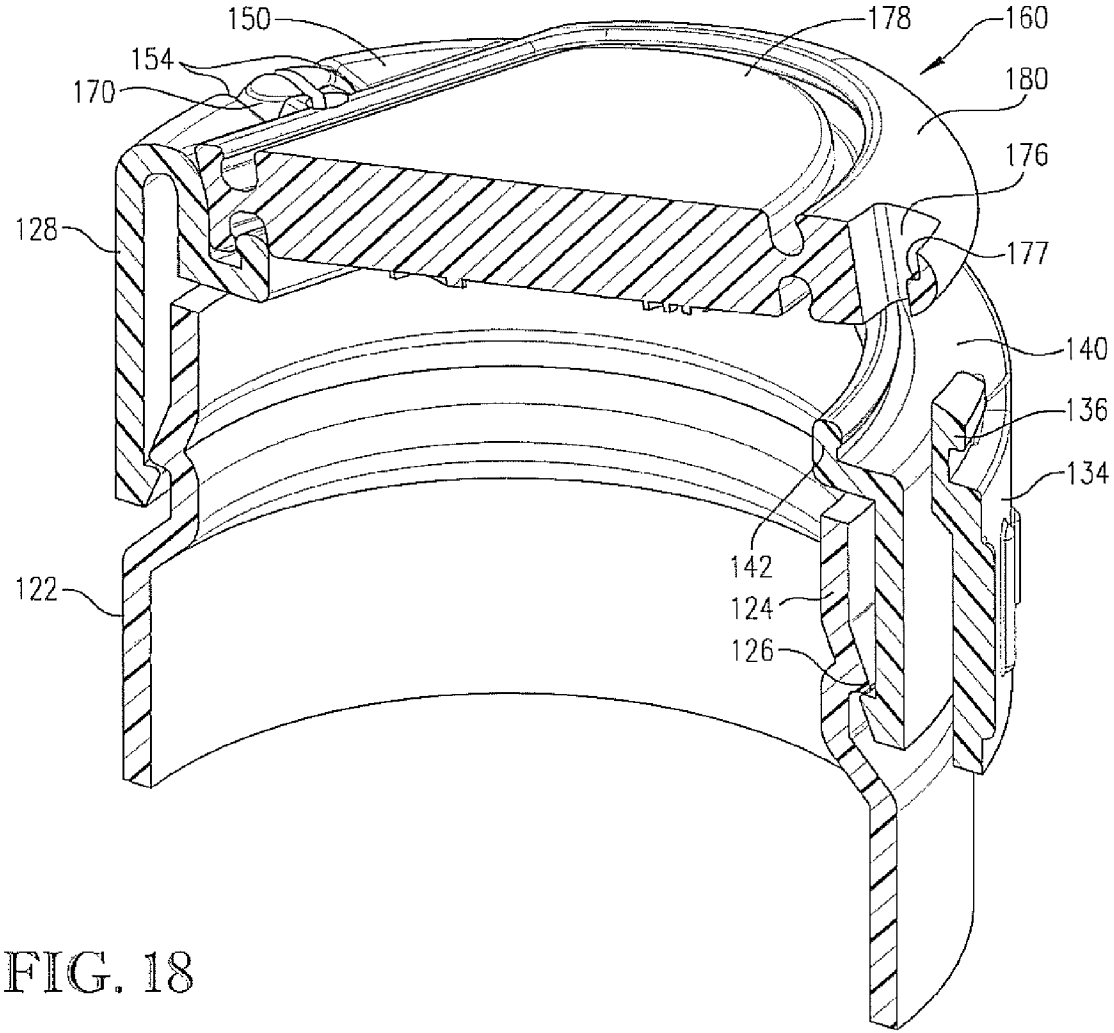
FIG. 18 is an enlarged, perspective view in vertical section illustrating the latch fully opened and allowing the closure assembly lid to be pivoted upwardly.

When it is desired to open lid 118, it is only necessary to press latching wall inwardly as illustrated by arrow 190 of FIG. 16, so as to inwardly shift locking lug 136 away from the latching surface 177. At this point the lid 118 can be pivoted upwardly to open the container assembly 110, such being permitted by virtue of mounting ball 170 pivoting within the mount 150.

When it is desired to convert the assembly 110 to the adult configuration, the lid 118 is opened as described whereupon the lid 118 is pivoted 180° (see FIGS. 19 and 20) until the first face 160 is adjacent the open top of container 112. The lid can then be closed such that the sealing wall 142 is received within the recess 182 of first face 160 and the locking lug 136 is received within through-slot 174. However, owing to the fact that the through-slot 174 has no latching recess, no latching connection is established between skirt 116 and lid 118. As such, the closure assembly 114 can be readily opened. Also, in this orientation the cautionary legend on second face 162 is visible.

As in the case of the first embodiment, the lid 118 is pivotal about respective transverse axes during opening of the lid and changeover between the child-resistant and adult configurations of the container assembly 110.

We claim:

1. A closure assembly for an open-top container and comprising:

a skirt section configured to be secured to the open top of said container and presenting an opening allowing access to the interior of said container;

a lid moveable between a closed position covering said opening, and an open position allowing access to the interior of said container through said opening; and connection apparatus operably coupling said lid to said skirt section and permitting said movement of the lid about a first pivot axis between said closed and opened position thereof, said connection apparatus including structure permitting rotation of said lid about a second rotational axis transverse to said first pivot axis, while said lid remains connected to said skirt, said lid presenting first and second opposed faces, said lid rotatable about said second rotational axis between a first position and a second position, wherein when said lid is in both said first and closed positions said first face faces said opening and said second face faces away from said opening, wherein when said lid is in both said second and closed positions said second face faces said opening and said first face faces away from said opening.

2. The closure assembly of claim 1, said skirt section including threading configured to be secured to complemental threading disposed about the open top of said container.

3. The closure assembly of claim 1, there being a latch operable to latch said lid to said skirt when the lid is in said first position thereof, whereby said latch must be operated in order to allow the lid to be moved from the closed to the open position thereof.

4. The closure assembly of claim 3, said latch comprising interengaging latching components carried by said lid and skirt, respectively.

5. The closure assembly of claim 3, said latch being inoperable when said lid is in said second position thereof whereby the lid may be moved from the closed to the open position thereof without need for delatching the lid.

6. The closure assembly of claim 1, wherein said connection apparatus comprises a segment hingedly coupled to said skirt for pivoting of the segment about an axis transverse to the through axis of said opening.

7. The closure assembly of claim 6, said lid being pivotally coupled with said segment and rotatable about an axis transverse to said segment pivot axis.

8. The closure assembly of claim 7, said segment having an aperture, said lid including a pin received within said segment aperture.

9. The closure assembly of claim 1, said connection apparatus comprising a ball joint connection between said lid and skirt.

10. The closure assembly of claim 9, said ball joint comprising a ball secured to said lid and received within a complemental ball opening formed in said skirt.

11. The closure assembly of claim 1, there being sealing structure providing a seal between the skirt and lid when the lid is in the closed position thereof.

12. The closure assembly of claim 11, said sealing structure providing a seal when the lid is closed in either the first or second position thereof.

13. The assembly comprising:

a container presenting an open top;

a closure assembly operably coupled with said container and including a skirt section secured to the open top of said container and presenting an opening allowing access to the interior of said container;

a lid moveable between a closed position covering said opening, and an open position allowing access to the interior of said container through said opening; and connection apparatus operably coupling said lid to said skirt section and permitting said movement of the lid about a first pivot axis between said closed and opened position thereof, said connection apparatus including structure permitting rotation of said lid about a second rotational axis transverse to said first pivot axis, while said lid remains connected to said skirt, said lid presenting first and second opposed faces, said lid rotatable about said second rotational axis between a first position and a second position, wherein when said lid is in both said first and closed positions said first face faces said opening and said second face faces away from said opening, wherein when said lid is in both said second and closed positions said second face faces said opening and said first face faces away from said opening.

14. The assembly of claim 13, said skirt section including threading secured to complemental threading disposed about the open top of said container.

15. The assembly of claim 13, there being a latch operable to latch said lid to said skirt when the lid is in said first position thereof, whereby said latch must be operated in order to allow the lid to be moved from the closed to the open position thereof.

16. The assembly of claim 13, said latch comprising interengaging latching components carried by said lid and skirt, respectively.

17. The assembly of claim 13, said latch being inoperable when said lid is in said second position thereof whereby the lid may be moved from the closed to the open position thereof without need for delatching the lid.

18. The assembly of claim 13, wherein said connection apparatus comprises a segment hingedly coupled to said skirt for pivoting of the segment about an axis transverse to the through axis of said opening.

19. The assembly of claim 18, said lid being pivotally coupled with said segment and rotatable about an axis transverse to said segment pivot axis.

20. The assembly of claim 19, said segment having an aperture, said lid including a pin received within said segment aperture.

21. The assembly of claim 13, said connection apparatus comprising a ball joint connection between said lid and skirt.

22. The assembly of claim 21, said ball joint comprising a ball secured to said lid and received within a complemental ball opening formed in said skirt.

23. The assembly of claim 13, there being sealing structure providing a seal between the skirt and lid when the lid is in the closed position thereof.

24. The assembly of claim 23, said sealing structure providing a seal when the lid is closed in either the first or second position thereof.

25. In a container assembly comprising an open-top container adapted to hold a potentially dangerous substance and a lid selectively openable to allow access to the interior of said container and a latch, said lid being alternately positionable without detachment of the lid from the container between a first position wherein said lid is latched and a second position wherein said lid is unlatched, the improvement which comprises a connection assembly allowing said lid to be rotated between a first lid position where one face of the lid is adjacent said container opening and the lid is latched, and a second lid position where the other face of the lid is adjacent said container opening and the lid is unlatched; wherein said connection apparatus includes a skirt secured to said container about the open top thereof, said lid operably coupled with said skirt.

* * * * *